US009037454B2

(12) United States Patent
Yoon et al.

(10) Patent No.: US 9,037,454 B2
(45) Date of Patent: May 19, 2015

(54) EFFICIENT CODING OF OVERCOMPLETE REPRESENTATIONS OF AUDIO USING THE MODULATED COMPLEX LAPPED TRANSFORM (MCLT)

(75) Inventors: Byung-Jun Yoon, Bryan, TX (US); Henrique S. Malvar, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 1947 days.

(21) Appl. No.: 12/142,809

(22) Filed: Jun. 20, 2008

(65) Prior Publication Data

US 2009/0319278 A1 Dec. 24, 2009

(51) Int. Cl.
*G10L 19/00* (2013.01)
*G10L 19/02* (2013.01)

(52) U.S. Cl.
CPC ..... *G10L 19/0212* (2013.01)

(58) Field of Classification Search
USPC ..... 704/203–210, 219–230
See application file for complete search history.

(56) References Cited

U.S. PATENT DOCUMENTS

| | | | |
|---|---|---|---|
| 6,256,608 | B1 | 7/2001 | Malvar |
| 6,496,795 | B1 | 12/2002 | Malvar |
| 7,266,697 | B2 | 9/2007 | Kirovski et al. |
| 7,272,556 | B1 | 9/2007 | Aguilar et al. |
| 7,319,775 | B2 | 1/2008 | Sharma et al. |
| 2004/0162866 | A1 | 8/2004 | Malvar |
| 2006/0074642 | A1 | 4/2006 | You |
| 2007/0174063 | A1 | 7/2007 | Mehrotra et al. |
| 2008/0015852 | A1 | 1/2008 | Kruger et al. |

OTHER PUBLICATIONS

Maciej Bartkowiak, "A unifying approach to transform and sinusoidal coding of audio", May 17-20, 2008, AES, pp. 1-7.*
Henrique S. Malvar, "Fast Algorithm for the Modulated Complex Lapped Transform", 2003, IEEE, pp. 8-10.*
Renate Vafin, "Rate-Distortion Optimized Quantization in Multi-stage Audio Coding", IEEE, Jan. 2005, pp. 311-320.*

(Continued)

*Primary Examiner* — Douglas Godbold
*Assistant Examiner* — Mark Villena
(74) *Attorney, Agent, or Firm* — Cassandra T. Swain; Judy Yee; Micky Minhas

(57) ABSTRACT

An "Overcomplete Audio Coder" provides various techniques for overcomplete encoding audio signals using an MCLT-based predictive coder. Specifically, the Overcomplete Audio Coder uses unrestricted polar quantization of MCLT magnitude and phase coefficients. Further, quantized magnitude and phase coefficients are predicted based on properties of the audio signal and corresponding MCLT coefficients to reduce the bit rate overhead in encoding the audio signal. This prediction allows the Overcomplete Audio Coder to provide improved continuity of the magnitude of spectral components across encoded signal blocks, thereby reducing warbling artifacts. Coding rates achieved using these prediction techniques are comparable to that of encoding an orthogonal representation of an audio signal, such as with modulated lapped transform (MLT)-based coders. Finally, the Overcomplete Audio Coder provides a true magnitude-phase frequency-domain representation of the audio signal, thus allowing precise auditory models to be applied for improving compression performance, without the need for additional Fourier transforms.

20 Claims, 7 Drawing Sheets

(56) References Cited

OTHER PUBLICATIONS

Scheuble, et al., "Scalable Audio Coding Using the Nonuniform Modulated Complex Lapped Transform", Proceedings of the Acoustics, Speech, and Signal Processing, 2001, On IEEE International Conference—vol. 05, 2001, pp. 3257-3260.
Ravelli, et al., "Representations of Audio Signals in Overcomplete Dictionaries: What is the Link Between Redundancy Factor and Coding Properties?", Proc. of the 9th Int. Conference on Digital Audio Effects (DAFx-06) Montreal, Canada, Sep. 18-20, 2006, pp. 267-270.
Piazza, et al. "Complex-Valued Arithmetic Boosts Audio DSP Applications for Automotive Infotainment (Digital Signal Processing and Complex Arithmetic)", http://www.audiodesignline.com/174402724, Nov. 28, 2005.
Seymour Shlien, "The Modulated Lapped Transform, Its Time-Varying Forms, and Its Applications to Audio Coding Standards", IEEE Transactions On Speech And Audio Processing, vol. 5, No. 4, Jul. 1997, pp. 359-366.
Henrique Malvar, "A Modulated Complex Lapped Transform and Its Applications to Audio Processing" International Conference on Acoustics, Speech, and Signal Processing, Technical Report, May 1999, pp. 1-9.
Davies, et al., "Sparse Audio Representations Using the MCLT", May 9, 2005, pp. 1-31.
Nick Kingsbury, "Complex Wavelets for Shift Invariant Analysis and Filtering of Signals", Journal of Applied and Computational Harmonic Analysis, vol. 10, No. 3, May 2001, pp. 1-25.
Daudet, et al., "MDCT Analysis of Sinusoids: Exact Results and Applications to Coding Artifacts Reduction", IEEE Transactions On Speech And Audio Processing, vol. 12, No. 3, May 2004, pp. 302-312.
Jayant, et al., "Signal Compression Based on Models of Human Perception", Proceedings of the IEEE, vol. 81, Issue 10, Oct. 1993, pp. 1385-1422.
Yaghoobi, et al., "Quantized Sparse Approximation with Iterative Thresholding for Audio Coding", IEEE International Conference on Acoustics, Speech and Signal Processing, vol. 1, Apr. 15-20, 2007, pp. 257-260.
Cheng, et al., "Audio Coding and Image Denoising Based on the Nonuniform Modulated Complex Lapped Transform", IEEE Transactions On Multimedia, vol. 7, No. 5, Oct. 2005, pp. 817-827.
Stephen G. Wilson, "Magnitude/Phase Quantization of Independent Gaussian Variates", IEEE Transactions on Communications, vol. COM-28, No. 11, Nov. 1980, pp. 1924-1929.
Vafin, et al., "Entropy-Constrained Polar Quantization and Its Applications to Audio Coding", IEEE Transactions On Speech And Audio Processing, vol. 13, No. 2, Mar. 2005, pp. 220-232.
Henrique S. Malvar, "Adaptive Run-Length/Golomb-Rice Encoding of Quantized Generalized Gaussian Sources with Unknown Statistics", Proceedings of the Data Compression Conference (DCC'06), Mar. 28-30, 2006, pp. 23-32.
Gillespie, et al., "Speech Dereverberation Via Maximumkurtosis Subband Adaptive Filtering", IEEE International Conference on Acoustics, Speech, and Signal Processing, 2001, vol. 6, pp. 3701-3704.
Burges, et al., "Extracting Noise-Robust Features from Audio Data", IEEE International Conference on Acoustics, Speech, and Signal Processing, 2002, vol. 1, 2002, pp. 1021-1024.
Nick Kingsbury, "Shift Invariant Properties of the Dual-Tree Complex Wavelet Transform", In Proc. IEEE Int. Conf. Acoust., Speech, Signal Processing, 1999, 4 pages.
Nick Kingsbury, "A Dual-Tree Complex Wavelet Transform with Improved Orthogonality and Symmetry Properties", International Conference on Image Processing, 2000, vol. 2, pp. 375-378.
Reeves, et al., "R-D Quantisation of Complex Coefficients in Zerotree Coding", Proceedings of the 11th IEEE Signal Processing Workshop on Statistical Signal Processing, 2001, pp. 480-483.
Kingsbury, et al., "Iterative image coding with overcomplete complex wavelet transforms", Proc. Conf. Visual Comm. and Image Processing, Lugano, Switzerland, Pages, Jul. 2003, 1253-1264.

* cited by examiner

PLOT OF MCLT COEFFICIENTS
FOR A PARTICULAR FREQUENCY OF A PIANO AUDIO SIGNAL

EFFICIENT CODING OF OVERCOMPLETE REPRESENTATIONS OF AUDIO USING THE MODULATED COMPLEX LAPPED TRANSFORM (MCLT)

BACKGROUND

1. Technical Field

An "Overcomplete Audio Coder" provides various techniques for encoding audio signals using modulated complex lapped transforms (MCLT), and in particular, to various techniques for implementing a predictive MCLT-based coder that significantly reduces the rate overhead caused by the overcomplete sampling nature of the MCLT, without the need for iterative algorithms for sparsity reduction.

2. Related Art

Most modern audio compression systems use a frequency-domain approach. The main reason is that when short audio blocks (say, 20 ms) are mapped to the frequency domain, for most blocks a large fraction of the signal energy is concentrated in relatively few frequency components, a necessary first step to achieve good compression. The mapping from time to frequency domain is usually performed by the modulated lapped transform (MLT), also known as the modified discrete cosine transform (MDCT). In general, the MLT is an overlapping orthogonal transform that allows for smooth signal reconstruction even after heavy quantization of the transform coefficients, without discontinuities across block boundaries (blocking artifacts).

One disadvantage of the MLT is that it does not provide a shift-invariant representation of the input signal. In particular, if the input signal is shifted by a small amount (e.g., ⅛th of a block), the resulting MLT transform coefficients will change significantly. In fact, just like with wavelet decompositions, there are no overlapping transforms or filter banks that can be both shift invariant and orthogonal.

For example, in the case where an audio signal is composed of a single sinusoid of constant frequency and amplitude, the MLT coefficients will vary from block to block. Therefore, if they are quantized, the reconstructed audio will be a modulated sinusoid. Unfortunately, when all harmonic components of a more complex audio signal (such as speech or music, for example) suffer from these modulations, "warbling" artifacts can be heard in the reconstructed signal.

These types of modulation artifacts can be significantly reduced if the MLT is replaced by a transform that supports a magnitude-phase representation, such as the modulated complex lapped transform (MCLT). However, the MCLT is an overcomplete (or oversampled) transform by a factor of two. In particular, the MCLT maps a block with M new real-valued signal samples into M complex-valued transform coefficients (with a real and an imaginary component for each signal sample, thereby oversampling by a factor of two). Unfortunately, while conventional MCLT-based coders can significantly reduce modulation artifacts, the inherent oversampling of such schemes significantly reduces compression performance of conventional MCLT-based coders.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In general, an "Overcomplete Audio Coder," as described herein, provides various techniques for overcomplete encoding of audio signals using an MCLT-based predictive coder that reduces coding bit rates relative to conventional MCLT-based coders. Specifically, the Overcomplete Audio Coder transforms MCLT coefficients computed from the audio signal from rectangular to polar coordinates, then uses unrestricted polar quantization of MCLT magnitude and phase coefficients in combination with prediction of the quantized magnitude and phase coefficients to provide efficient encoding of audio signals. Magnitude and phase coefficients of the MCLT are predicted based on an evaluation of properties of the audio signal and corresponding MCLT coefficients.

The prediction techniques provided by the Overcomplete Audio Coder provide several advantages over conventional MCLT-based coders. For example, the MCLT inherently oversamples the audio signal by a factor of two relative to modulated lapped transform (MLT)-based audio coders or Fast Fourier Transform (FFT)-based audio coders. Thus, the result of using an MCLT-based coder is a theoretical doubling of the coding rate of audio signals relative to MLT- and FFT-based coders. However, the unique prediction techniques provided by the Overcomplete Audio Coder allow the bit rate overhead of encoded audio signals to be reduced to a level that is comparable to that of encoding an orthogonal representation of an audio signal, such as with MLT- or FFT-based coders, while maintaining perceptual quality in reconstructed audio signals.

Further the predictive techniques offered by the Overcomplete Audio Coder ensures improved continuity of the magnitude of spectral components across encoded signal blocks, thereby reducing warbling artifacts. In addition, due to the oversampling nature of the MCLT, the Overcomplete Audio Coder provides twice the frequency resolution of discrete FFT-based coders, thereby allowing for higher precision auditory models that can be computed directly from the MCLT coefficients. Note that due to the prediction techniques provided by the Overcomplete Audio Coder, this higher precision does not come at the cost of increased coding rates.

In various embodiments, the Overcomplete Audio Coder also uses different bit rates to coarsely quantize the phase of MCLT coefficients depending upon the magnitude of the MCLT coefficients in order to achieve a desired perceived fidelity level. Since human hearing is more sensitive to magnitude than phase, the magnitude of the MCLT coefficients is quantized at a finer level (i.e., smaller quantization steps). Further, in combination with the use of different bit rates for quantizing the phase for different MCLT magnitude levels, a scaling factor is applied to increase or decrease the magnitude of MCLT coefficients, with increased MCLT coefficient magnitudes corresponding to increased fidelity (i.e., more bits are used to quantize phase for higher magnitudes). The scaling factor is then either encoded with the audio signal, or provided as a side stream in combination with the encoded audio signal, for use by the decoder in decoding and reconstructing the audio signal. Further, in various embodiments, variable MCLT block lengths are used in order to provide optimal MCLT transforms as a function of audio content.

In view of the above summary, it is clear that the Overcomplete Audio Coder described herein provides various unique techniques for implementing a predictive MCLT-based coder that significantly reduces the rate overhead caused by the overcomplete sampling nature of the MCLT. In addition to the just described benefits, other advantages of the Overcomplete Audio Coder will become apparent from the detailed description that follows hereinafter when taken in conjunction with the accompanying drawing figures.

DESCRIPTION OF THE DRAWINGS

The specific features, aspects, and advantages of the claimed subject matter will become better understood with regard to the following description, appended claims, and accompanying drawings where:

DETAILED DESCRIPTION OF THE EMBODIMENTS

Figure 1:
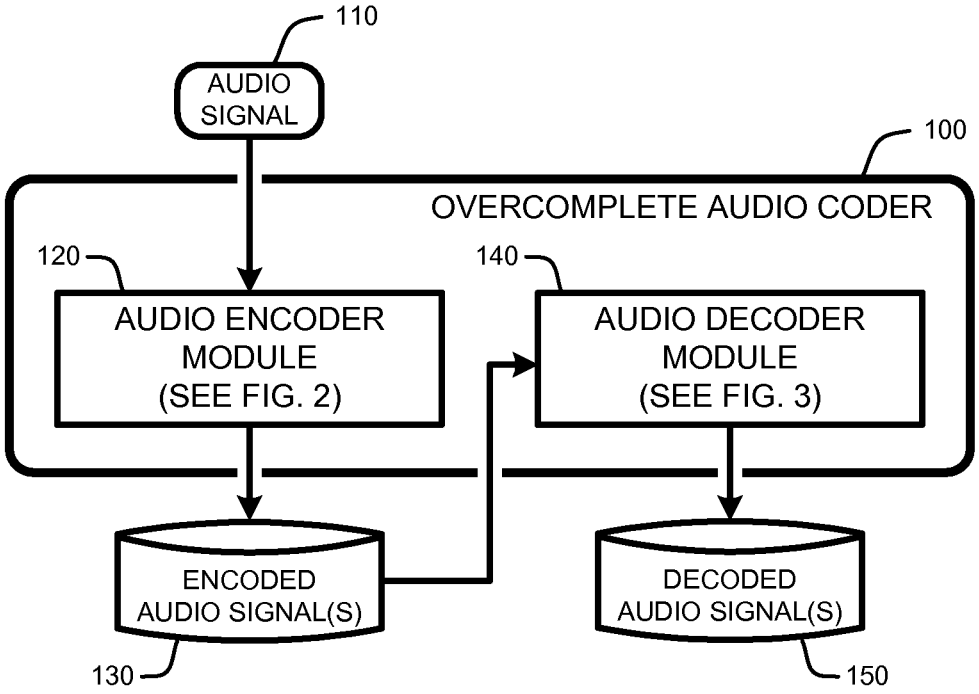
FIG. 1 provides an exemplary architectural flow diagram that illustrates program modules, including an audio encoder module and an audio decoder module, for implementing various embodiments of an Overcomplete Audio Coder, as described herein.

In the following description of the embodiments of the claimed subject matter, reference is made to the accompanying drawings, which form a part hereof, and in which is shown by way of illustration specific embodiments in which the claimed subject matter may be practiced. It should be understood that other embodiments may be utilized and structural changes may be made without departing from the scope of the presently claimed subject matter.

1.0 Introduction:

In general, an "Overcomplete Audio Coder," as described herein, provides various techniques for encoding audio signals using an MCLT-based predictive coder. Specifically, the Overcomplete Audio Coder performs a rectangular to polar conversion of MCLT coefficients, and then performs an unrestricted polar quantization (UPQ) of the resulting MCLT magnitude and phase coefficients. Note that since human hearing is more sensitive to magnitude than phase, the magnitude of the MCLT coefficients is quantized at a finer level (i.e., smaller quantization steps) than the phase.

Further, quantized magnitude and phase coefficients are predicted based on properties of the audio signal and corresponding MCLT coefficients to reduce the bit rate overhead in encoding the audio signal. These predictions are then used to construct an encoded version of the audio signal. Prediction parameters from the encoder side of the Overcomplete Audio Coder are then passed to a decoder of the Overcomplete Audio Coder for use in reconstructing the MCLT coefficients of the encoded audio signal, with an inverse MCLT then being applied to the resulting coefficients following a conversion back to rectangular coordinates.

Further, the unique prediction capabilities provided by the Overcomplete Audio Coder provide improved continuity of the magnitude of spectral components across encoded signal blocks, thereby reducing warbling artifacts. In addition, coding rates achieved using the prediction techniques described herein are comparable to that of encoding an orthogonal representation of an audio signal, such as with modulated lapped transform (MLT)-based coders.

As noted above, UPQ techniques are used to quantize a magnitude/phase representation of the MCLT of the audio signal following a conversion of the MCLT from rectangular to polar coordinates. In various embodiments, different bit rates are used to quantize the phase of the MCLT depending upon the magnitude of the MCLT in order to achieve a desired perceived fidelity level. Note that as discussed in further detail herein, perceived fidelity does not always directly equate to mathematical rate/distortion levels due to the nature of human hearing. Such factors are considered when determining the number of bits to be used for quantizing the MCLT phase at the various MCLT magnitude levels.

Further, in combination with the use of different bit rates for different MCLT magnitude levels, a scaling factor is applied to increase or decrease the magnitude of MCLT coefficients, with increased MCLT coefficient magnitudes corresponding to increased fidelity (i.e., more bits are used to quantize phase for higher magnitudes). In various embodiments, this scaling factor is set as a user definable value via a user interface to increase or decrease the resulting bit rate of the encoded audio signal to achieve a desired fidelity of the decoded audio signal. In additional embodiments, the scaling factor is automatically set for groups of one or more contiguous blocks of MCLT coefficients based on either an analysis of the audio signal (in either the time or frequency domain), or upon predicted entropy levels during the encoding of the audio signal. In either case, the scaling factor is then either encoded with the audio signal, or provided as a side stream in combination with the encoded audio signal, for use by the decoder in decoding and reconstructing the audio signal.

Figure 2:
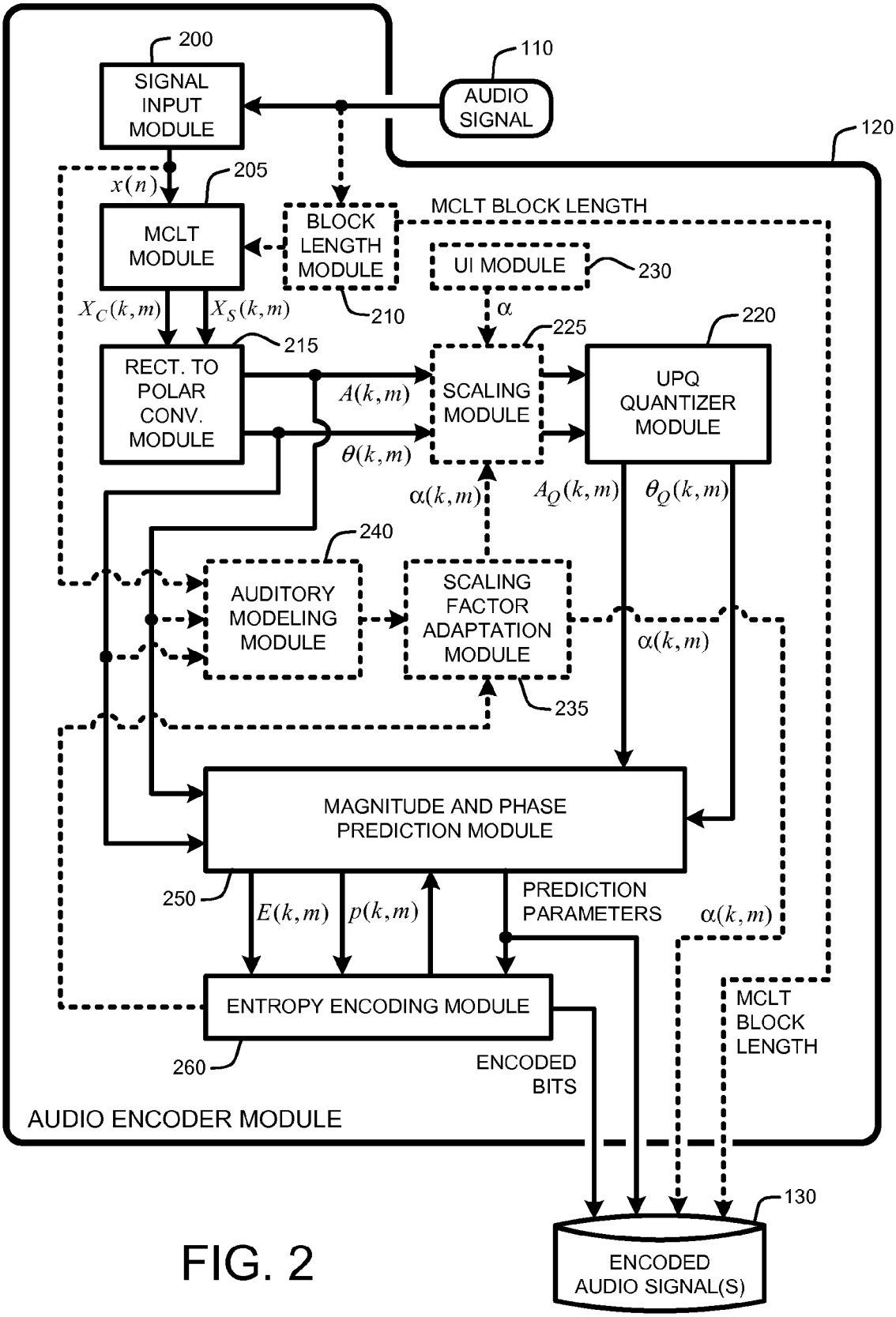
FIG. 2 provides an exemplary architectural flow diagram that illustrates program modules for implementing various embodiments of the audio encoder module of FIG. 1, as described herein.

1.1 System Overview:

As noted above, the Overcomplete Audio Coder provides various techniques for implementing a predictive MCLT-based coder that significantly reduces the rate overhead caused by the overcomplete sampling nature of the MCLT. The processes summarized above are illustrated by the general system diagrams of FIG. 1, FIG. 2 and FIG. 3. In particular, the system diagram of FIG. 1 illustrates the interrelationships between program modules for implementing various embodiments of the Overcomplete Audio Coder, including an audio encoder module and an audio decoder module, as described herein. FIG. 2 then expands upon the audio encoder module, while FIG. 3 expands upon the audio decoder module of the Overcomplete Audio Coder. Furthermore, while the system diagrams of FIG. 1, FIG. 2, and FIG. 3 illustrate a high-level view of various embodiments of the Overcomplete Audio Coder, these figures are not intended to provide an exhaustive or complete illustration of every possible embodiment of the Overcomplete Audio Coder as described throughout this document.

Figure 3:
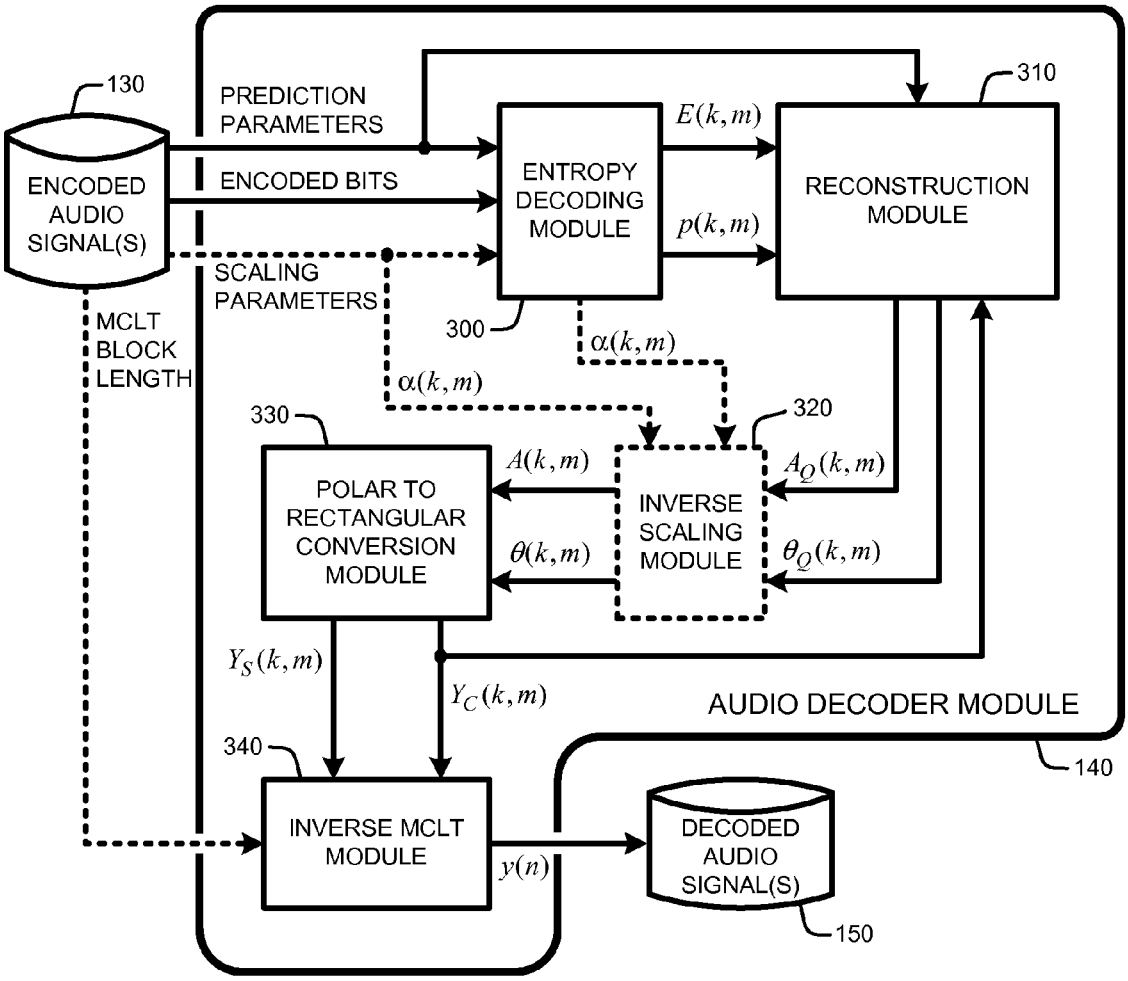
FIG. 3 provides an exemplary architectural flow diagram that illustrates program modules for implementing various embodiments of the audio decoder module of FIG. 1, as described herein.

In addition, it should be noted that any boxes and interconnections between boxes that are represented by broken or dashed lines in any of FIG. 1, FIG. 2, or FIG. 3 represent alternative embodiments of the Overcomplete Audio Coder described herein. Further, any or all of these alternative embodiments, as described below, may be used in combination with other alternative embodiments that are described throughout this document.

In general, as illustrated by FIG. 1, the processes enabled by the Overcomplete Audio Coder 100 begin operation by using an audio encoder module 120 to receive an audio signal 110, either from a prerecorded source, or from a live input. The audio encoder module 120 then uses predictive MCLT-based encoding to produce an encoded audio signal 130 from the input audio signal 110. Note that as discussed in further detail below, in various embodiments, the encoded audio signal 130 includes additional information, either encoded with the audio data or provided as a side stream or the like, for use in decoding the encoded audio signal. In various embodiments, this additional information includes some or all of MCLT block length data, scaling factor information used to scale MCLT coefficients prior to quantization, and prediction parameters used for predicting magnitude and phase of MCLT coefficients.

Once the Overcomplete Audio Coder 100 has constructed the encoded audio signal 130 from the input audio signal 110, the encoded audio signal can then be provided to an audio decoder module 140 of the Overcomplete Audio Coder for reconstruction of a decoded version of the original audio signal.

Note that while FIG. 1 illustrates the audio encoder module 120 and audio decoder module 140 as being included in the same Overcomplete Audio Coder, the audio encoder module and the audio decoder module may reside and operate on either the same computer or on different computers or computing devices.

For example, one typical use of the Overcomplete Audio Coder would be for one computing device to encode one or more audio signals, and then provide those encoded audio signals to one or more other computing devices for decoding and playback or other use following decoding. Note that the encoded audio signal can be provided to other computers or computing devices across wired or wireless networks or other communications channels using conventional data transmission techniques (not illustrated in FIG. 1).

Further, there is no requirement that any particular computing device has both the audio encoder module 120 and the audio decoder module 140 of the Overcomplete Audio Coder. A simple example of this idea would be a media playback device, such as a Zune®, for example, that receives encoded audio files via a wired or wireless sync to a host computer that encoded those audio files using its own local copy of the audio encoder module 120. The media playback device would then decode the encoded audio signal 130 using its own local copy of the audio decoder module 140 whenever the user wanted to initiate playback of a particular encoded audio signal.

1.1.1 Audio Encoder Module:

As noted above, FIG. 2 expands upon the audio encoder module 120 of FIG. 1. In particular, encoding of audio files begins by using a signal input module 200 to receive the audio signal 110. An MCLT module 205 then computes the real and imaginary MCLT coefficients of the MCLT, as discussed in further detail in Section 2.2.

In various embodiments, the audio signal 110 is first evaluated by a block length module 210 to determine an optimal MCLT block length, on a frame-by-frame basis, for use by the MCLT module 205. In this case, the optimal MCLT block length is provided to the MCLT module 205 for use in computing the MCLT coefficients, and also provided as a side stream of bits to be either encoded with, or included with, the encoded audio signal 130 for use in decoding the encoded audio signal. Note that optimal block length selection for MCLT processing is known to those skilled in the art, and will not be described in detail herein.

Following computation of the MCLT coefficients, those coefficients are then passed to a rectangular to polar conversion module 215 that converts the real and imaginary parts of the MCLT coefficients to a magnitude and phase representation of the MCLT coefficients using the polar coordinate system. See Section 2.2 and Equation (3) for further details regarding this conversion to polar coordinates.

The magnitude-phase representations of the MCLT coefficients produced by the rectangular to polar conversion module 215 are then passed to an unrestricted polar quantizer (UPQ) module 220, which quantizes the MCLT coefficients as described in Section 2.4. In particular, the UPQ quantization described in Section 2.4 uses a different number of bits to encode phase of the MCLT coefficients as a direct function of the magnitude of the MCLT coefficients. In other words, as the magnitude of the MCLT coefficients increases, the UPQ quantizer module 220 generally uses more bits to encode the phase of the MCLT coefficients. The result is that higher magnitude coefficients are encoded at a higher level of fidelity since more bits are used for encoding the phase of those higher magnitude coefficients.

Further, in various embodiments, prior to the quantization performed by the UPQ quantizer module 220, a scaling module 225 is used to scale the magnitude of the MCLT coefficients in order to achieve a desired fidelity level, as described in further detail in Section 2.4. In particular, rate-distortion performance of encoded audio signals is controlled by a single parameter: a scaling factor, $\alpha$, that is applied to the MCLT coefficients prior to magnitude-phase quantization. Then, as the scaling factor, $\alpha$, is increased, the scaled magnitude increases, with a resulting increase in the bit rate, and vice versa.

As the scaling factor, $\alpha$, increases, the fidelity of the encoded audio signal increases along with the bit rate of the encoded signal. Consequently, as the scaling factor, $\alpha$, increases, the compression ratio of the encoded audio signal decreases. As such, the scaling factor, $\alpha$, can be considered as providing a tradeoff between quality and compression. Note that the scaling factor information is also provided as a side stream of bits to be either encoded with, or included with, the encoded audio signal 130 for use in decoding the encoded audio signal as described in further detail in Section 2.6.1.

In various embodiments, the scaling factor, $\alpha$, applied by the scaling module 225 is set as a constant value via a user interface (UI) module 230. In further embodiments, the scaling factor, $\alpha$, is determined automatically for one or more contiguous blocks of MCLT coefficients using a scaling factor adaption module 235. In particular, in various embodiments, the scaling factor adaptation module 235 sets the scaling factor, $\alpha$, based on an ongoing analysis of the audio signal 110 via an auditory modeling module 240 (in either the frequency domain or in the time domain). The results of this analysis are then used by the scaling factor adaptation module 235 determine which scale factor to use for each MCLT coefficient of each block, based on the auditory modeling module's 240 determination of the audibility of errors in that coefficient. In a related embodiment, the scaling factor adaptation module 235 determines which scale factor to use for each MCLT coefficient based upon rate/distortion parameters estimated by an entropy encoding module 260 (discussed in further detail below).

Next, the UPQ quantizer module 220 passes the quantized magnitude-phase representation of the MCLT coefficients to a magnitude and phase prediction module 250. In various embodiments, the magnitude and phase prediction module 250 predicts either or both the magnitude and phase of MCLT coefficients using various techniques.

For example, as discussed in detail in Section 2.5, in view of the significant observed correlation between the magnitude of consecutive MCLT samples, A(k,m−1) and A(k,m), where m is the block (or frame) index and k is the frequency (or subband) index, instead of encoding A(k,m) directly, the Overcomplete Audio Coder encodes a residual, E(k,m), from a linear prediction based on previously-transmitted samples. In another embodiment, the Overcomplete Audio Coder also predicts the phase of MCLT coefficients based on an observed relationship between the phase of consecutive blocks of the MCLT. In particular, this relationship between the phase of consecutive blocks of the MCLT allows the Overcomplete Audio Coder to encode just the phase difference, p(k,m), between actual phase values and the difference predicted by Equation (5) and Equation (6), as described in Section 2.5.

In related embodiments, magnitude and phase prediction module 250 of the Overcomplete Audio Coder applies an additional prediction step to generate "prediction parameters" which are included in with the encoded audio signal 130. In particular, as described in Section 2.5.1, if just the absolute value of the phase $|\theta(k)|$ is known, the real part of the MCLT, $X_C(k)$, can be reconstructed since $\cos[\theta(k)]=\cos[-\theta(k)]$. Further, only the sign of $\theta(k)$ is needed in order to reconstruct $X_S(k)$. If all $X_C(k)$ are known. Therefore, since only the sign of $\theta(k)$ is needed in order to reconstruct $X_S(k)$, then $X_S(k)$ does not need to be encoded. Consequently, in various embodiments, the magnitude and phase prediction module 250 aggregates the signs of all encoded phase coefficients into a vector and replaces them by predicted signs computed from a real-to-imaginary component prediction (i.e., the sign resulting from a prediction of $X_S(k)$ from $X_C(k)$).

Finally, an entropy encoding module 260 uses conventional encoding techniques to provide lossless encoding of the prediction residuals, E(k,m), the predicted phase differences, p(k,m), and additional prediction parameters, such as the predicted signs computed from the real-to-imaginary component prediction for use in reconstructing the real and imaginary components of the MCLT, as described in Section 2.5. Note that in place of an entropy coder, such as, for example, adaptive arithmetic encoders or adaptive run-length Golomb-Rice (RLGR) encoders, the Overcomplete Audio Coder can use any other lossless or lossy encoder desired. However, the use of lossy encoding will tend to reduce perceived sound quality in the reconstructed audio signal.

1.1.2 Audio Decoder Module:

As illustrated by FIG. 3, once the encoded audio signal 130 is constructed by the audio encoder module 120, as described in Section 1.1.1, the decoder module 140 of the Overcomplete Audio Coder decodes the encoded audio signal and reconstructs a version of the original input signal as the decoded audio signal 150. More specifically, the processes described above with respect to encoding of the audio signal 110 are generally reversed in order to generate the decoded audio signal.

For example, an entropy decoding module 300 receives the encoded audio signal 130, and decodes that signal to recover the prediction residuals, E(k,m), the predicted phase differences, p(k,m), and the prediction parameters. Note that the prediction parameters are wither encoded as a part of the encoded audio signal, or are provided as a side stream included with the encoded audio signal. Assuming that scaling of the magnitude of the MCLT coefficients was also used, as described in Section 1.1.1, those scaling parameters will also be recovered, either from a side stream associated with the encoded audio signal 130, or directly from decoding the encoded audio signal itself, depending upon how that information was included with the encoded audio signal.

A reconstruction module 310 reverses the prediction processes of the magnitude and phase prediction module 250 described with respect to FIG. 2, in order to reconstruct the quantized versions of the magnitude and phase of each MCLT coefficient, and $A_Q(k)$ and $\theta_Q(k)$, respectively. An inverse scaling module 320 then applies the inverse of the scaling factor, $\alpha$, (i.e., $1/\alpha$) to the recovered magnitude MCLT coefficients, to recover the unscaled versions, and A(k) and $\theta(k)$, respectively.

These new values after inverse scaling are then provided to a polar to rectangular conversion module 330 which recovers the real and imaginary components of the MCLT, $Y_C(k,m)$ and $Y_S(k,m)$, in the rectangular coordinate system. Note that the notation $Y_C(k,m)$ and $Y_S(k,m)$ is used in place of the original $X_C(k,m)$ and $X_S(k,m)$ to represent the MCLT coefficients since the MCLT coefficients recovered by the audio decoder module 140 are not identical to the MCLT coefficients computed directly from the input audio signal due to the quantization steps performed by the audio encoder module 120.

Finally, an inverse MCLT module 340 simply performs an inverse MCLT on $Y_C(k,m)$ and $Y_S(k,m)$ to recover the decoded audio signal 150, y(n), which represents the decoded version of the original input signal 110. The decoded audio signal 150 can then be provided for playback or other use, as desired.

2.0 Overcomplete Audio Coder Operational Details:

The above-described program modules are employed for implementing various embodiments of the Overcomplete Audio Coder. As summarized above, the Overcomplete Audio Coder provides various techniques for implementing a predictive MCLT-based coder that significantly reduces the rate overhead caused by the overcomplete sampling nature of the MCLT.

The following sections provide a detailed discussion of the operation of various embodiments of the Overcomplete Audio Coder, and of exemplary methods for implementing the program modules described in Section 1 with respect to FIG. 1. In particular, the following sections describe examples and operational details of various embodiments of the Overcomplete Audio Coder, including: an operational overview of the Overcomplete Audio Coder; overcomplete audio representations using the MCLT; conventional encoding of MCLT representations; magnitude-phase quantization; and operation details of various audio encoding embodiments of the Overcomplete Audio Coder.

2.1 Operational Overview of the Overcomplete Audio Coder:

In general, the Overcomplete Audio Coder provides various techniques for encoding audio signals using MCLT-based predictive coding. Specifically, the Overcomplete Audio Coder performs a rectangular to polar conversion of MCLT coefficients, and then performs an unrestricted polar quantization (UPQ) of the resulting MCLT magnitude and phase coefficients. Further, quantized magnitude and phase coefficients are predicted based on properties of the audio signal and corresponding MCLT coefficients to reduce the bit rate overhead in encoding the audio signal. These predictions are then used to construct an encoded version of the audio signal. Prediction parameters from the encoder side of the Overcomplete Audio Coder are then passed to a decoder of the Overcomplete Audio Coder for use in reconstructing the MCLT coefficients of the encoded audio signal, with an inverse MCLT then being applied to the resulting coefficients following a conversion back to rectangular coordinates.

2.2 Overcomplete Audio Representations Using the MCLT:

As is understood by those skilled in the art of MCLT-based signal processing, the MCLT achieves a nearly shift-invariant representation of the encoded signal because it supports a magnitude-phase decomposition that does not suffer from time-domain aliasing. Thus, the MCLT has been successfully applied to problems such as audio noise reduction, acoustic echo cancellation, and audio watermarking. However, the price to be paid is that the MCLT expands the number of samples by a factor of two, because it maps a block with M new real-valued signal samples into M complex-valued transform coefficients. Namely, the MCLT of a block of an audio signal x(n) is given by a block of frequency-domain coefficients X(k), in the form $$X(k)=X_C(k)+jX_S(k) \quad \text{Equation 1}$$

where k is the frequency index (with k=0, 1, . . . , M−1), $j \triangleq \sqrt{-1}$ and $$X_C(k)=\sqrt{\frac{2}{M}}\sum_{n=0}^{2M-1} h(n)x(n)\cos\left[\left(n+\frac{M+1}{2}\right)\left(k+\frac{1}{2}\right)\frac{\pi}{M}\right] \quad \text{Equation 2}$$

$$X_S(k)=\sqrt{\frac{2}{M}}\sum_{n=0}^{2M-1} h(n)x(n)\sin\left[\left(n+\frac{M+1}{2}\right)\left(k+\frac{1}{2}\right)\frac{\pi}{M}\right]$$

and where $X_C(k)$ is the "real" part of the transform, and $X_S(k)$ is the imaginary part of the transform. Note that the summation extends over 2M samples because M samples are new while the other M samples come from overlapping.

The set $\{X_C(k)\}$, the real part of the transform, forms the MLT of the signal. Thus, unlike in Fourier transform, there is a simple reconstruction formula from the real part only, as well as one from the imaginary part only, since each is an orthogonal transform of the signal. However, the best reconstruction processes generally use both the real and imaginary parts. In particular, using both the real and imaginary components for reconstruction removes time-domain aliasing. Each of the sets $\{X_C(k)\}$ and $\{X_S(k)\}$ forms a complete orthogonal representation of a signal block, and thus the set $\{X(k)\}$ is "overcomplete" by a factor of two.

The real-imaginary representation in of the MCLT illustrated in Equation (1) can be converted to a magnitude-phase representation by as illustrated by Equation (3), as illustrated below:

$$X(k)=A(k)e^{j\theta(k)} \quad \text{Equation 3}$$

where $X_C(k)=A(k)\cos[\theta(k)]$, $X_S(k)=A(k)\sin[\theta(k)]$, and A(k) and θ(k) are the magnitude and phase components, respectively.

One of the main advantages of the magnitude-phase representation of the MCLT provided in Equation (3) is that for a constant-amplitude and constant-frequency sinusoid signal, the magnitude coefficients will be constant from block to block. Thus, even under coarse quantization of the magnitude coefficients, a quantized MCLT representation is likely to lead to less warbling artifacts, as discussed in further detail in Section 2.4.

Another advantage of the magnitude-phase MCLT representation provided in Equation (3) is that the magnitude spectrum can be used directly for the computation of auditory models in a perceptual coder without the need to compute an additional Fourier transform, as with MP3 encoders, or the need to rely on MLT-based pseudo-spectra as an approximation of the magnitude spectrum, as done in some MLT-based digital audio encoders.

2.3 Conventional Encoding of MCLT Representations:

As discussed in Section 2.2, the MCLT has several advantages over the MLT for audio processing. However, for conventional compression applications, an overcomplete representation such as the MCLT creates a data expansion problem. In particular, since the best reconstruction formulas use both the real and imaginary components of the MCLT, an encoder has to send both to a decoder, thus potentially doubling the bit rate of the compressed audio signal. However, doubling the bit rate of encoded audio is generally considered an undesirable trait for many applications, especially applications that involve storage limitations or bandwidth limited network transmissions.

For example, assuming a given quantization threshold, one conventional approach to reducing redundancy in having both real and imaginary MCLT coefficients is to try to shrink the number of nonzero coefficients via conventional iterative thresholding methods. For image coding, such methods are capable of essentially eliminating redundancy in terms of rate/distortion (R/D) performance, when using the also overcomplete dual-tree complex wavelet. There are two main disadvantages of those methods, though. First, convergence is slow, so the dozens of required iterations are likely to increase encoding time considerably. Second, and most important for audio, the method does not guarantee that if $X_C(k)$ is nonzero at a particular frequency, k, then $X_S(k)$ will also be nonzero, or vice-versa. Thus, the magnitude and phase information is lost while introducing time-domain aliasing artifacts at that frequency. The result is significant distortion in the decoded audio signal.

Another conventional approach is to predict the imaginary coefficients from the real ones. For a given block, if both the previous and next block were available, then the time-domain waveform could be reconstructed, and from it, $X_S(k)$ could be computed exactly. However, that would introduce an extra block delay, which is undesirable in many applications. Using only the current and previous block, it is possible to approximately predict $X_S(k)$ from $X_C(k)$. Then, the prediction error from the actual values of $X_S(k)$ can be encoded and transmitted. It is also possible to first encode $X_C(k)$, and predict $X_S(k)$ for the frequencies, k, for which $X_C(k)$ is nonzero. That way, for every frequency k for which data is transmitted, both the real and imaginary coefficients are transmitted. However, that approach still leads to a significant rate overhead, mainly because the prediction of the imaginary part from the real part without using future data is not very efficient.

As described in further detail below, in contrast to conventional MCLT-based coders, which start with twice the data as that in a traditional MLT-based encoder, the Overcomplete Audio Coder described herein provides various techniques for efficiently encoding MCLT coefficients without doubling, or otherwise significantly increasing, the bit rate.

2.4 Magnitude-Phase Quantization:

In order to attenuate warbling artifacts in encoded audio, an explicit magnitude-phase representation is used, as illustrated with respect to Equation (3). Towards this end, the magnitude and phase coefficients and A(k) and θ(k) (polar quantization) are quantized, instead of quantizing the real and imaginary coefficients $X_C(k)$ and $X_S(k)$ (rectangular quantization).

Figure 4:
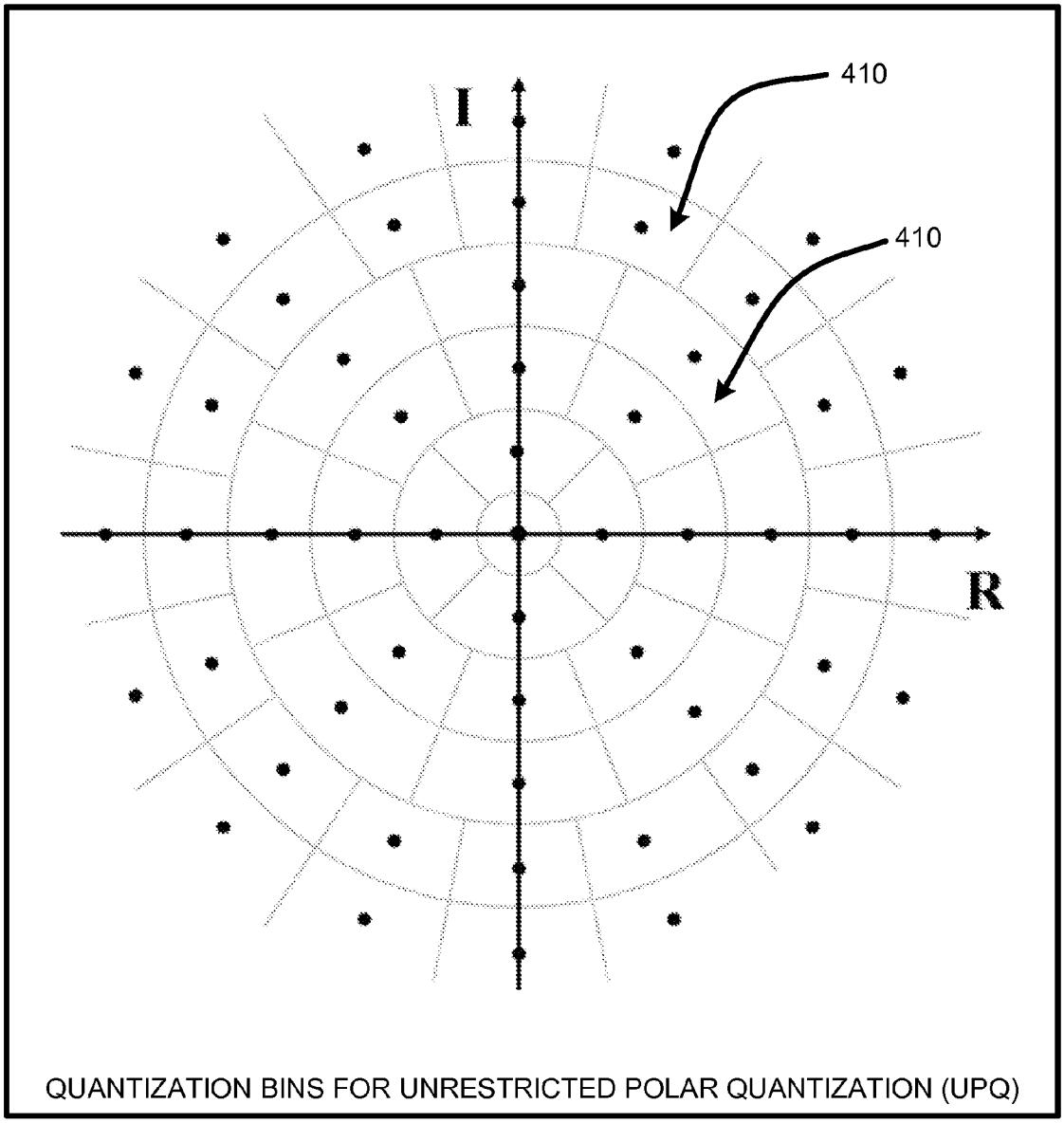
FIG. 4 illustrates an example of quantization bins for unrestricted polar quantization (UPQ) for quantizing magnitude-phase representations of MCLT coefficients, as described herein.

It is well known to those skilled in the art that polar quantization can lead to essentially the same rate-distortion performance of rectangular quantization, as long as the phase quantization is made coarser for smaller magnitude values, as illustrated by the quantization bins 410 shown in FIG. 4. This approach is generally referred to as unrestricted polar quantization (UPQ). Note that the necessity for making phase quantization coarser for smaller values is an intuitive result, because if the number of phase quantization levels were to be set independent of magnitude, then the quantization bins near the origin would have much smaller areas, thus leading to an increase in entropy. Since human hearing is more sensitive to magnitude than phase, the magnitude of the MCLT coefficients is quantized at a finer level (i.e., smaller quantization steps). Note that the rings in FIG. 4 represent magnitude levels, and that lower magnitude levels generally (but not always) have fewer bins for phase values.

It should be noted that near-optimal properties of UPQ apply for quantization of uncorrelated complex-valued Gaussian random variables. However, two unrelated properties make it difficult to directly apply such results for use with the Overcomplete Audio Coder. First, for many short-time music segments, amplitudes of tones tend to vary slowly from block to block, thus the values of a particular MCLT magnitude coefficient A(k) are generally correlated from block to block. Second, the human ear is relatively insensitive to phase. Consequently, phase quantization errors may lead to increases in root-mean-square (RMS) errors that may not lead to proportional decreases in perceived quality. Therefore, straight R/D results may not apply, and some experimentation is typically needed to identify the proper adjustment of the quantization bins in the UPQ (see FIG. 4).

In performing experiments to find proper adjustments for the quantization bin size, it was observed that for most audio content, including speech and music, random phase errors in MCLT coefficients of up to $\pi/8$ are nearly imperceptible to a human listener, even when listening with high-quality headphones. However, coarser quantization may bring warbling and echo artifacts.

Further, in tests of the Overcomplete Audio Coder, it was observed that it is not generally necessary to use more than about 4 bits to quantize the phase of high-magnitude coefficients, and fewer bits for quantizing lower-magnitude coefficients in order to produce satisfactory coding quality (with respect to a human listener). However, it should be clear that using more bits increases audio fidelity (at the cost of increased bit rate for the encoded audio). These numbers (i.e., bits/phase magnitude) can be determined by experimentation or can be set to any desired level to achieve a particular result. Further, if the magnitude is quantized to zero, then, of course, no phase information is needed. In a tested embodiment that worked well for musical audio content, for nonzero magnitude values, the number of bits for various levels of phase magnitude, $X_M$, was assigned as indicated in Table 1, which corresponds to the UPQ plot in FIG. 4.

TABLE 1

Practical Parameter Values for UPQ Quantization

| | Range of Phase Magnitude, $X_M$ | | | | | |
|---|---|---|---|---|---|---|
| | 0 to 0.5 | 0.5 to 1.5 | 1.5 to 2.5 | 2.5 to 3.5 | 3.5 to 4.5 | >4.5 |
| Number of Bits for Phase, $\phi$ | 0 | 2 | 3 | 3 | 4 | 4 |

With the UPQ bins being defined as illustrated by Table 1, the rate-distortion performance is controlled by a single parameter: a scaling factor, $\alpha$, that is applied to the MCLT coefficients prior to magnitude-phase quantization. Then, as the scaling factor, $\alpha$, is increased, the scaled magnitude increases, with a resulting increase in the bit rate, as illustrated by Table 1. Clearly, as the bit rate increases, the fidelity of the encoded audio will also increase. Further, in tested embodiments of the Overcomplete Audio Coder, it was observed that even with the relatively coarse phase quantization illustrated in Table 1, warbling artifacts are reduced, when compared to quantization of MLT coefficients. Note that in tested embodiments, the scaling factor, $\alpha$, was generally much less than a value of 1. However, it should also be noted that that the value of the scaling factor, $\alpha$, depends on the particular audio content of the audio signal (e.g. the number of bits used in the original PCM representation of the audio samples) and the desired fidelity level of the encoded signal.

Figure 5:
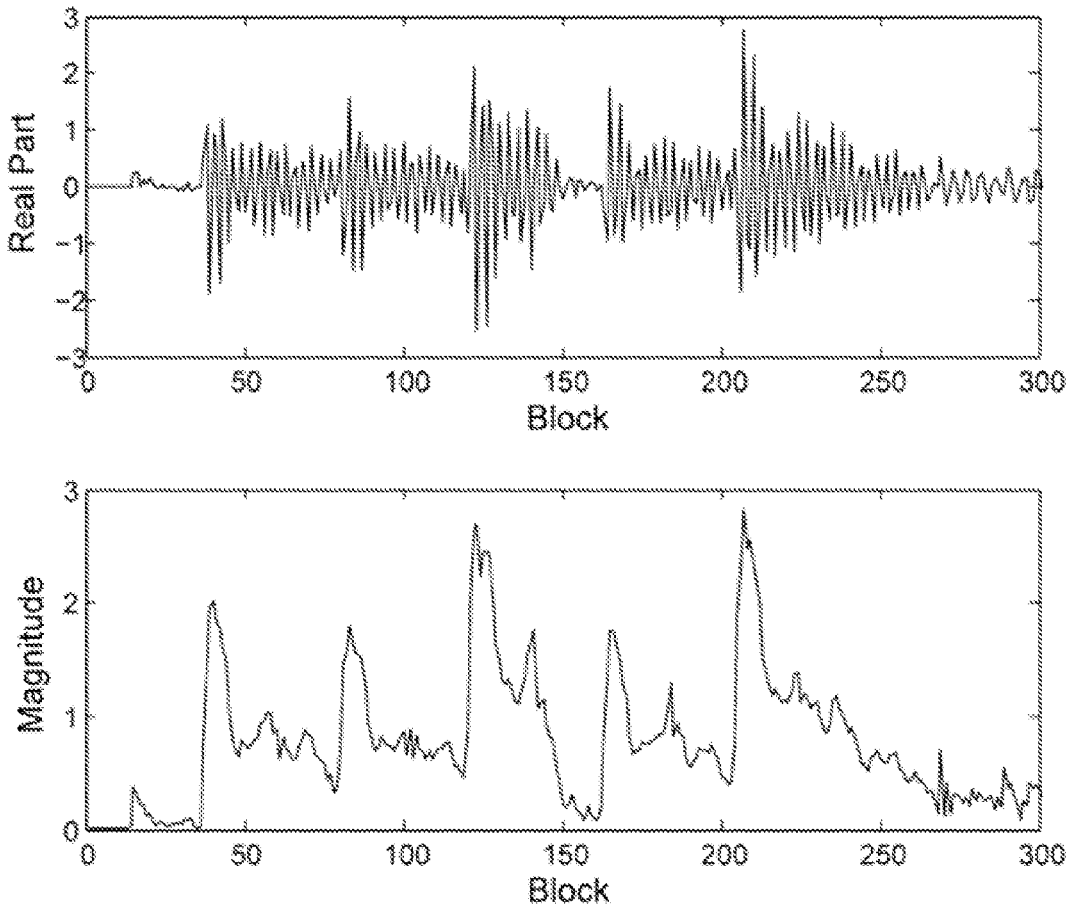
FIG. 5 illustrates a plot of MCLT coefficients for a particular frequency of a piano audio signal, showing that magnitude values are strongly correlated from block to block (i.e. frame to frame), as described herein.

2.5 Magnitude and Phase Prediction:

FIG. 5 shows plots of the real part $X_C(k)$ and the magnitude, A(k), of the MCLT of a piano test signal sampled at 16 kHz, for subband k=5, in a MCLT representation with M=512 subbands. Clearly, there is significant correlation between consecutive samples A(k,m−1) and A(k,m), where m is the block (or frame) index. Consequently, this correlation provides the basis for the prediction techniques used by the Overcomplete Audio Coder. In particular, in various embodiments, instead of encoding A(k,m) directly, the Overcomplete Audio Coder instead encodes the residual from a linear prediction based on previously-transmitted samples, as illustrated by Equation (4):

$$E(k, m) \triangleq A(k, m) - \sum_{r=1}^{L} b_r A(k, m - r) \qquad \text{Equation 4}$$

where L is the predictor order and $\{b_r\}$ is the set of predictor coefficients, which can be computed via an autocorrelation analysis. For most blocks the optimal predictor order L can be very low, on the order of about L=1 to L=3. Further, the values of L and $\{b_r\}$ can be encoded in the header for each block.

In addition, in various embodiments, the Overcomplete Audio Coder also predicts the phase of MCLT coefficients. In particular, based on an evaluation of the conventional computation of MLT coefficients for sinusoidal inputs, it was observed that if the input signal is a sinusoid at the center frequency of the kth subband, then the phase of two consecutive blocks will satisfy the relationship illustrated by Equation (5), where:

$$\theta(k, m) = \theta(km - 1) + \left(k + \frac{1}{2}\right)\pi \qquad \text{Equation 5}$$

Therefore, in view of the observations codified by Equation (5), the Overcomplete Audio Coder uses this relationship to encode just the phase difference, p(k,m), between θ(k) and the value predicted by Equation (5), as illustrated by Equation (6), where:

$$p(k, m) \triangleq \theta(k, m) - \theta(k, m - 1) - \left(k + \frac{1}{2}\right)\pi \qquad \text{Equation 6}$$

Note that for most audio signals, components are not exactly sinusoidal, and their frequencies are not at the center of the subbands. Thus, prediction efficiency varies from block to block and across subbands.

2.5.1 Sign Prediction:

In various embodiments, an additional prediction step is applied to the phase. In particular, from Equation (3), it can be seen that that if just $|\theta(k)|$ is known, the real part of the MCLT, $X_C(k)$, can be reconstructed since $\cos[\theta(k)]=\cos[-\theta(k)]$. Further, only the sign of $\theta(k)$ is needed in order to reconstruct $X_S(k)$.

As noted above, predicting $X_S(k)$ from $X_C(k)$ (i.e., a real-to-imaginary component prediction) may not be particularly precise. However, if the precision is good enough to at least get the sign of $X_S(k)$ correctly, then the sign of $\theta(k)$ is known. Therefore, since only the sign of $\theta(k)$ is needed in order to reconstruct $X_S(k)$, then $X_S(k)$ does not need to be encoded. Therefore, in various embodiments, the Overcomplete Audio Coder aggregates the signs of all encoded phase coefficients into a vector and replaces them by predicted signs computed from the real-to-imaginary component prediction (i.e., a prediction of $X_S(k)$ from $X_C(k)$). Again, it should be noted that only the sign of this prediction is kept, since the actual prediction of $X_S(k)$ is assumed to be relatively inaccurate. Without prediction, the phase signs would have roughly an entropy of one bit per encoded value (because signs are equally likely to be positive or negative), but after prediction the entropy is further reduced.

2.6 Audio Encoder Operation:

The concepts discussed above are used to construct various embodiments of an audio encoder and audio decoder of the Overcomplete Audio Coder. More specifically, as discussed with respect to FIG. 2, for each block (or frame) of the input signal, x(n), the audio encoder of the Overcomplete Audio Coder first computes its MCLT coefficients $X_C(k,m)$ and $X_S(k,m)$. Then, from these values, the Overcomplete Audio Coder computes the corresponding magnitude and phase coefficients $A(k,m)$ and $\theta(k,m)$, where m denotes the block index.

For audio signals sampled at 16 kHz, a block length on the order of about of M=512 samples generally provides good results, whereas for CD-quality audio sampled at 44.1 or 48 kHz, a block size on the order of about of M=2,048 samples generally works well. Note that for CD-quality audio, usually a fixed time-frequency resolution does not produce good reproduction of transient sounds. Thus, a block-size switching technique is employed, e.g. using M=2,048 for blocks with mostly tonal components, and M=256 for blocks with mostly transient components (see the discussion of the block length module 210 in FIG. 2, and the additional discussion of MCLT length in Section 2.6.2). Note that when applying block size switching techniques to the encoder described herein, the Overcomplete Audio Coder cannot predict the quantized coefficients for the first block after size switching.

Next, the Overcomplete Audio Coder quantizes the magnitude and phase coefficients using the UPQ polar quantizer (see FIG. 4), thereby producing the corresponding quantized values $A_Q(k,m)$ and $\theta_Q(k,m)$. Note that, as discussed with respect to FIG. 2, in various embodiments, the scaling factor $\alpha$ is used to multiply the MCLT coefficients subsequent to the polar conversion. Note that scaling can instead be applied prior to polar conversion, if desired, so long as the scaling is performed prior to the polar quantization.

In various embodiments, the scaling factor is either input via a user interface, as a way to allow the user to implicitly control encoding fidelity, or the scaling factor is determined automatically as a function of audio characteristics determined via the auditory modeling module 240 discussed with respect to FIG. 2. As noted above, the scaling factor $\alpha$ controls rate/distortion; the higher its value, the higher the fidelity and the bit rate. At the decoder, the coefficients are simply multiplied by $1/\alpha$ prior to the inverse MCLT.

The quantized magnitude and phase coefficients then go through the prediction steps described in Section 2.5. Note that in computing the predictors in Equations (5) and (6) the quantized values $A_Q(k,m)$ and $\theta_Q(k,m)$ are used so that the decoder can recompute the predictors. Note that in Equation (6), the phase prediction is indicated in the original continuous-valued domain. Therefore, to map it to a prediction in the UPQ-quantized domain, it is observed that for every cell in the UPQ diagram in FIG. 4, a cell with the same magnitude but with a phase equal to the original phase plus an integer multiple of $\pi/2$ is also in the diagram.

The final step is simply to entropy encode the quantized prediction residuals and store the encoded audio signal for later use, as desired.

Besides the encoded bits corresponding to the processed MCLT coefficients, additional parameters should be encoded and added to the bitstream (or included as a side stream, if desired). Those include the scaling factor $\alpha$, the number of subbands M (i.e., MCLT length), the predictor order L, the prediction coefficients $\{b_r\}$, and any other additional parameters necessary to control the specific entropy coder used in implementing the Overcomplete Audio Coder. It has been observed that unless compression ratios are high enough for artifacts to be very strong, the bit rate used by the parameters is less than 5% of that used for the encoded MCLT coefficients.

2.6.1 Adaptive Quantization:

In Section 2.4, it was noted that in various embodiments, MCLT coefficients are multiplied by a scale factor $\alpha$ prior to the polar quantization (UPQ) step. In the simplest embodiment, $\alpha$ is a fixed value, which can be chosen via the user interface module 230 described with respect to FIG. 2, so as to provide a desired tradeoff between quality and rate. The larger the value of $\alpha$, the larger the range of magnitude values that need to be represented, and thus the higher the bit rate, but also the higher the fidelity (i.e., reduced relative quantization error).

In a related embodiment, the audio Overcomplete Audio Coder adjust the value of $\alpha$ for each block (or for a group of one or more contiguous blocks), so that a desirable bit rate for that block (or group of blocks) is achieved. In another related embodiment, the scale factor $\alpha$ is controlled by an auditory model (see the discussion of the auditory modeling module 240 described with respect to FIG. 2) that determines which scale factor to use for each MCLT coefficient of each block (or for a group of one or more contiguous blocks), based on the model's determination of the audibility of errors in that coefficient. Of course, the encoder cannot send to the decoder the values of all scale factors for each coefficient, since that's about as much information as the audio signal itself. Rather, it sends (that is, adds to the block header) the values of a limited number of auditory model parameters, from which the decoder can compute the scale factors for each coefficient.

2.6.2 Variable Block Size:

As noted above, the block size M can be variable (i.e., variable length MCLT). A simple approach is to select long blocks (such as, for example, M=2,048) when the audio signal has mostly nearly-stationary tonal components, and select short blocks (such as, for example, M=256) when the signal has strong transient components. In this case, the encoder then has to add an extra bit of information to the frame header, to indicate the selected block size. A more flexible embodiment adds a few bits to each block, to indicate the size of that block, e.g. from a table of allowable sizes (say 128, 256, 512, 2,048, 4,096, etc.). Note that in the case where block-size switching is employed, prediction of magnitude and phase is turned off for every block whose size is different from the previous block, because the prediction techniques above assume no change in block size. In this case, if there are too many changes in block size, the benefits of reduced bit rate provided by prediction are lost. As such, frequency of block size switching should be considered when deciding on desired coding rates.

Figure 6:
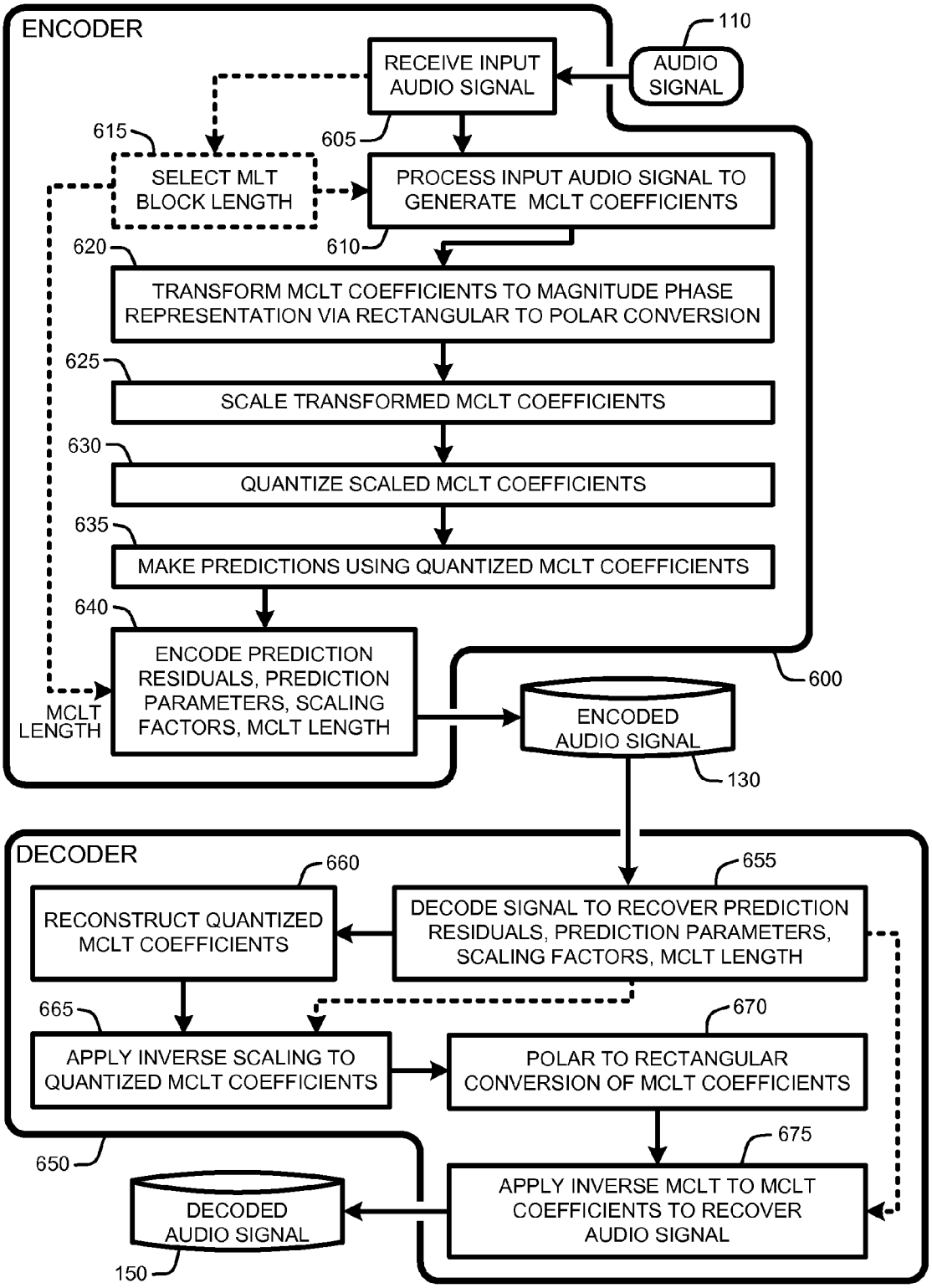
FIG. 6 provides general system flow diagram that illustrates exemplary methods for implementing various embodiments of the Overcomplete Audio Coder, as described herein.

3.0 Operational Summary of the Overcomplete Audio Coder:

The processes described above with respect to FIG. 1 through FIG. 5, and in further view of the detailed description provided above in Section 1 and Section 2 are summarized by the general operational flow diagram of FIG. 6. In particular, FIG. 6 provides an exemplary operational flow diagram that illustrates operation of some of the various embodiments of the Overcomplete Audio Coder described above. Note that FIG. 6 is not intended to be an exhaustive representation of all of the various embodiments of the Overcomplete Audio Coder described herein, and that the embodiments represented in FIG. 6 are provided only for purposes of explanation.

Further, it should be noted that any boxes and interconnections between boxes that may be represented by broken or dashed lines in FIG. 6 represent optional or alternate embodiments of the Overcomplete Audio Coder described herein. Further, any or all of these optional or alternate embodiments, as described below, may be used in combination with other alternate embodiments that are described throughout this document.

In general, as illustrated by FIG. 6, an encoder 600 portion of the Overcomplete Audio Coder begins operation by receiving 605 the audio input signal 110. The audio input signal 110 is then processed to generate 610 MCLT coefficients. As discussed in Section 2.6.2, in various embodiments, a variable block size is used when generating 610 the MCLT coefficients. In various embodiments, the block size is selected 615 based on an analysis of the audio signal 110.

The MCLT coefficients are them transformed 620 to a magnitude-phase representation via a rectangular to polar conversion process. The transformed MCLT coefficients are then scaled 625 using a scaling factor. As discussed in Section 2.6.1, the scaling factor is either specified via a user interface, or automatically determined based on an analysis of the audio signal or as a function of a desired coding rate.

The scaled magnitude-phase representation of the MCLT coefficients are then quantized using the UPQ quantization process described above in Section 2.4 and Section 2.6. These quantized coefficients are then provided to a prediction engine that predicts 635 magnitude and phase of MCLT coefficients from prior coefficients, and outputs the residuals of the prediction process for encoding 640, along with other prediction parameters, scaling factors and MCLT length to construct the encoded audio signal 130.

When decoding the encoded audio signal 130, a decoder 650 portion of the Overcomplete Audio Coder first decodes 655 the encoded audio signal 130 to recover the prediction residuals, along with other prediction parameters, scaling factors and MCLT length, as applicable. The prediction residuals and other prediction parameters are then used by the decoder 650 to reconstruct 660 the quantized MCLT coefficients.

The recovered scaling factor is then used by the decoder 650 to apply an inverse scaling 665 to the quantized MCLT coefficients. The resulting unscaled MCLT coefficients are then transformed 670 via a polar to rectangular conversion to recover versions of the original MCLT coefficients generated (see step 610) by the encoder 600. Finally, an inverse MCLT is applied 675 to the recovered MCLT coefficients to recover the decoded audio signal 150.

Figure 7:
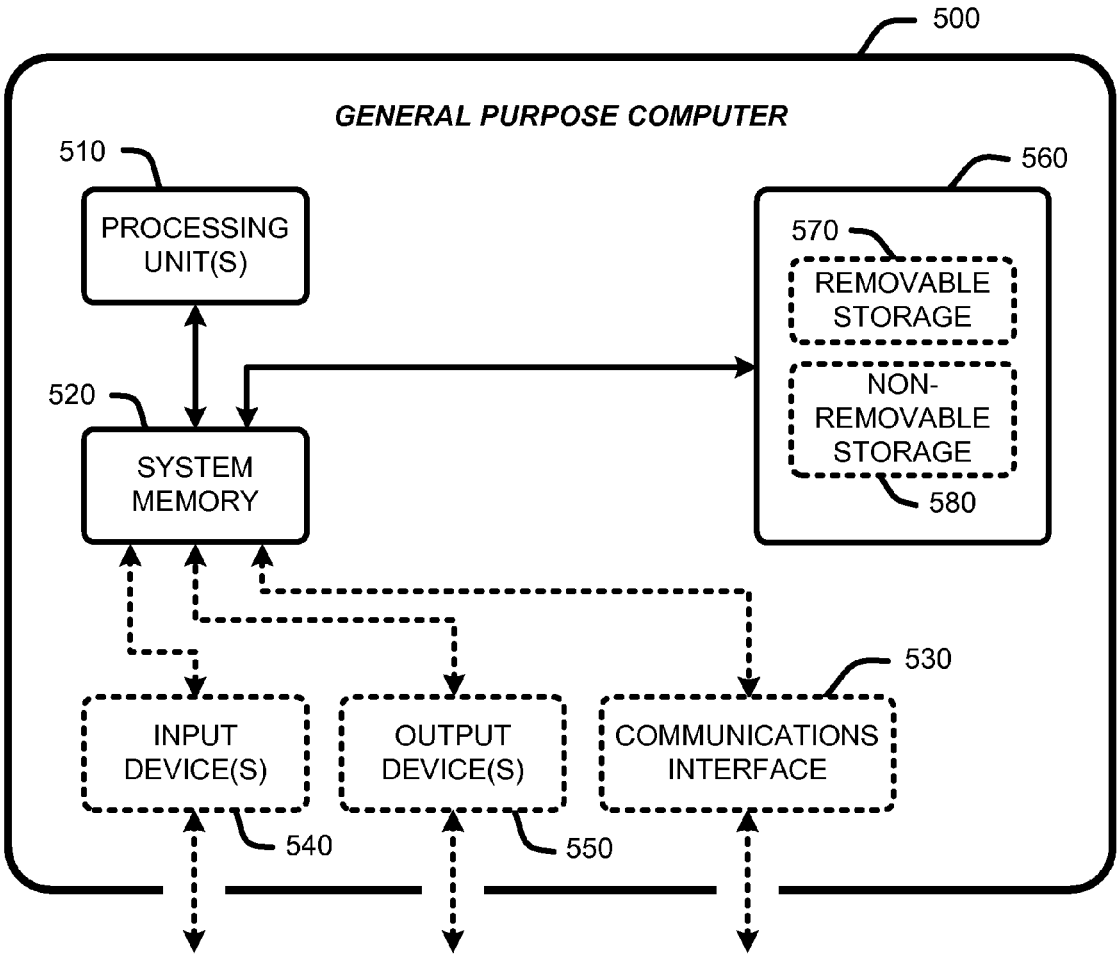
FIG. 7 is a general system diagram depicting a simplified general-purpose computing device having simplified computing and I/O capabilities for use in implementing various embodiments of the Overcomplete Audio Coder, as described herein.

4.0 Exemplary Operating Environments:

The Overcomplete Audio Coder is operational within numerous types of general purpose or special purpose computing system environments or configurations. FIG. 7 illustrates a simplified example of a general-purpose computer system on which various embodiments and elements of the Overcomplete Audio Coder, as described herein, may be implemented. It should be noted that any boxes that are represented by broken or dashed lines in FIG. 7 represent alternate embodiments of the simplified computing device, and that any or all of these alternate embodiments, as described below, may be used in combination with other alternate embodiments that are described throughout this document.

For example, FIG. 7 shows a general system diagram showing a simplified computing device. Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, etc.

At a minimum, to allow a device to implement the Overcomplete Audio Coder, the device must have some minimum computational capability along with a network or data connection or other input device for receiving audio signals or audio files.

In particular, as illustrated by FIG. 7, the computational capability is generally illustrated by one or more processing unit(s) 710, and may also include one or more GPUs 715. Note that that the processing unit(s) 710 of the general computing device of may be specialized microprocessors, such as a DSP, a VLIW, or other micro-controller, or can be conventional CPUs having one or more processing cores, including specialized GPU-based cores in a multi-core CPU.

In addition, the simplified computing device of FIG. 7 may also include other components, such as, for example, a communications interface 730. The simplified computing device of FIG. 7 may also include one or more conventional computer input devices 740. The simplified computing device of FIG. 7 may also include other optional components, such as, for example, one or more conventional computer output devices 750. Finally, the simplified computing device of FIG. 7 may also include storage 760 that is either removable 770 and/or non-removable 780. Note that typical communications interfaces 730, input devices 740, output devices 750, and storage devices 760 for general-purpose computers are well known to those skilled in the art, and will not be described in detail herein.

The foregoing description of the Overcomplete Audio Coder has been presented for the purposes of illustration and description. It is not intended to be exhaustive or to limit the claimed subject matter to the precise form disclosed. Many modifications and variations are possible in light of the above teaching. Further, it should be noted that any or all of the aforementioned alternate embodiments may be used in any combination desired to form additional hybrid embodiments of the Overcomplete Audio Coder. It is intended that the scope of the invention be limited not by this detailed description, but rather by the claims appended hereto.

What is claimed is:

1. A system for encoding an audio signal, comprising:

a device for processing an input audio signal using a modulated complex lapped transforms (MCLT) to produce blocks of transform coefficients for the audio signal;

a device for transforming the MCLT coefficients to a magnitude-phase representation via a rectangular to polar conversion;

a device for scaling the MCLT coefficients using a scaling factor;

a device for quantizing the magnitude and phase of the scaled MCLT coefficients into quantization bins using polar quantization;

wherein separate bit rates are selected for each scaled MCLT coefficient from a set of predefined bit rates for quantizing the phase of each scaled MCLT coefficient, with each selected bit rate corresponding to a particular pre-defined range of magnitudes of the scaled MCLT coefficients; and a device for encoding the quantized magnitude and phase of the scaled MCLT coefficients to create an entropy encoded version of the input audio signal, wherein a rate-distortion level of the encoded version of the input audio signal is directly controlled by the scaling factor as a result of the bit rates selected for quantizing the phase of each scaled MCLT coefficient, and wherein the scaling factor is included in the encoded version of the input audio signal.

2. The system of claim 1 wherein the scaling factor is automatically set for one or more contiguous frames of the input audio signal based on an auditory modeling of the input audio signal in order to achieve a desired fidelity level in the encoded version of the input audio signal.

3. The system of claim 1 wherein the scaling factor is dynamically set for one or more contiguous frames of the input audio signal based on predicted entropy levels during entropy encoding of the quantized magnitude and phase of the scaled MCLT coefficients.

4. The system of claim 1 wherein the polar quantization is an unrestricted polar quantization (UPQ).

5. The system of claim 1 further comprising:

a device for using the quantized magnitude-phase representations of the scaled MCLT coefficients to predict magnitude-phase representations of each scaled MCLT coefficient, with corresponding prediction residuals, from each immediately preceding scaled MCLT coefficient; and wherein encoding the scaled MCLT coefficients comprises encoding the prediction residual of one or more of the scaled MCLT coefficients in combination with zero or more of the scaled MCLT coefficients to create the encoded version of the input audio signal.

6. The system of claim 1 further comprising:

a device for determining a sign of the phase of each scaled MCLT coefficient resulting from a real-to-imaginary scaled MCLT component prediction; and wherein the predicted sign of the phase of each scaled MCLT coefficient is encoded in place of the quantized phase of the scaled MCLT coefficients to create the encoded version of the input audio signal.

7. The system of claim 1 wherein the MCLT uses a variable block length that is automatically determined for groups of one or more consecutive frames by analyzing the content of the input audio signal, and wherein the block length is included in the encoded version of the input audio signal.

8. A method performed by a computing device for encoding an audio signal, comprising steps for:

processing sequential overlapping frames of samples of an audio signal using a modulated complex lapped transform (MCLT) to compute a block of transform coefficients for each frame of the audio signal;

transforming the MCLT coefficients to a magnitude-phase representation via a rectangular to polar conversion;

quantizing the magnitude and phase of the MCLT coefficients into quantization bins using polar quantization, and wherein separate bit rates are selected for each magnitude-phase representation from a set of predefined bit rates for encoding the phase of each MCLT coefficient, with each selected bit rate corresponding to a particular pre-defined range of magnitudes of the magnitude-phase representations;

using the quantized magnitude-phase representations of the MCLT coefficients to predict magnitude-phase representations of each MCLT coefficient, with corresponding prediction residuals, from each immediately preceding MCLT coefficient; and entropy encoding the prediction residuals of one or more of the quantized magnitude-phase representations of the MCLT coefficients in combination with zero or more of the magnitude-phase representations of the MCLT coefficients to encode the audio signal.

9. The method of claim 8 further comprising scaling the MCLT coefficients using a scaling factor prior to quantizing the magnitude-phase representations of the MCLT coefficients.

10. The method of claim 9 wherein a coding rate of the encoded audio signal is varied by varying the scaling factor.

11. The method of claim 9 wherein the polar quantization is an unrestricted polar quantization (UPQ).

12. The method of claim 9 wherein the scaling factor is automatically set for one or more contiguous frames of the audio signal based on an auditory modeling of the audio signal in order to achieve a desired fidelity level in the encoded audio signal.

13. The method of claim 8 wherein the MCLT uses a variable block length that is automatically determined for groups of one or more consecutive frames by analyzing the content of the audio signal.

14. The method of claim 8 further comprising:

determining a sign of the phase of each MCLT coefficient resulting from a real-to-imaginary MCLT component prediction; and wherein the predicted sign of the phase of each MCLT coefficient is encoded in place of the quantized phase of the MCLT coefficients to encode the audio signal.

15. A process for decoding compressed audio data, comprising using a computing device to perform steps for:

receiving compressed audio data including a combination of:

encoded prediction residuals computed from one or more quantized magnitude-phase representations of modulated complex lapped transform (MCLT) coefficients of an audio signal, and zero or more encoded quantized magnitude-phase representations of the MCLT coefficients of the audio signal, such that all MCLT coefficients of the audio signal are represented once in the compressed audio data by the combination of one or more prediction residuals and zero or more quantized magnitude-phase representations of the MCLT coefficients;

decoding the compressed audio data to recover the prediction residuals and the quantized magnitude-phase representations of the MCLT coefficients;

reconstructing predicted quantized magnitude-phase representations of MCLT coefficients from corresponding recovered prediction residuals;

transforming the predicted magnitude-phase representations of the MCLT coefficients and the recovered magnitude-phase representations of the MCLT coefficients via a polar to rectangular conversion; and performing an inverse MCLT operation on the transformed MCLT coefficients to recover a decoded version of the audio signal.

16. The process of claim 15 further comprising steps for recovering a scaling factor from the compressed audio data, and wherein:

the scaling factor was used to scale all MCLT coefficients of the audio signal prior to encoding the compressed audio data; and wherein the predicted magnitude-phase representations of the MCLT coefficients and the recovered magnitude-phase representations of the MCLT coefficients are unscaled using the scaling factor prior to the transforming step.

17. The process of claim 16 wherein bit rates used in quantizing a phase of the magnitude-phase representations of the MCLT coefficients during encoding of the compressed audio data vary as a direct function of a magnitude of the magnitude-phase representations of the MCLT coefficients.

18. The process of claim 17 wherein the scaling factor regulates a fidelity level of the compressed audio data as a result of the varying bit rates used in quantizing the phase of the magnitude-phase representations of the MCLT coefficients.

19. The process of claim 18 wherein the scaling factor used during encoding of the compressed audio data is dynamically determined for one or more contiguous frames of the audio signal based on an auditory modeling of the audio signal in order to achieve a desired fidelity level in the compressed audio data.

20. The process of claim 15 wherein the inverse MCLT uses a variable block length that is recovered from the compressed audio data on a frame-by-frame basis for every frame of the compressed audio data.

* * * * *